United States Patent [19]

Brush, Jr. et al.

[11] Patent Number: 4,561,179

[45] Date of Patent: Dec. 31, 1985

[54] METHOD FOR ELECTRICAL CONNECTION TO THE CENTER CONDUCTOR OF AN INSULATED WIRE

[75] Inventors: Robert W. Brush, Jr., North Brunswick, N.J.; Robert D. Waghorn, Oneonta, N.Y.

[73] Assignee: Allied Corporation, Morris Township, Morris County, N.J.

[21] Appl. No.: 637,990

[22] Filed: Aug. 6, 1984

Related U.S. Application Data

[62] Division of Ser. No. 505,651, Jun. 20, 1983.

[51] Int. Cl.[4] ..... H01R 43/04

[52] U.S. Cl. ..... 29/866; 339/97 R; 339/223 S

[58] Field of Search ..... 29/863, 865, 866, 857; 339/223 S, 97 R, 89 C, 177 R

[56] References Cited

U.S. PATENT DOCUMENTS

| | | | |
|---|---|---|---|
| Re. 26,994 | 12/1970 | Fuller et al. | 339/97 R X |
| 1,753,627 | 4/1930 | Schwarzmann et al. | 339/223 S X |
| 2,291,434 | 7/1942 | Hollopeter et al. | 339/97 R X |

*Primary Examiner*—Howard N. Goldberg
*Assistant Examiner*—Carl J. Arbes
*Attorney, Agent, or Firm*—C. D. Lacina

[57] ABSTRACT

A terminal (20; 20') comprised of a tubular metal sleeve (23; 33') includes four insulation slicing-conductor penetrating fins (26; 42) and a coaxially disposed conductor penetrating conical spike (32, 40) to provide a redundant electromechanical connection with a center conductor (16) of a wire (10), the fins extending longitudinally along and radially inward from the interior wall (24A) of the sleeve (23; 33') to terminate in a penetrating point (**26*p*; 44) and the conical spike (32, 40) terminating in a point (32A; 45A) for impaling itself into the center conductor (16), the fins longitudinally slicing through the wire insulation (12) to expose the conductor (16) and the conical spike (32; 40**) simultaneously impaling itself into the center of the conductor to expand the conductor and the sliced insulation radially outward, inward radial crimping of the sleeve driving the fins into the conductor and press-fitting the insulation segments against the sleeve to form a mechanical fitment therewith.

2 Claims, 11 Drawing Figures

FIG. 1
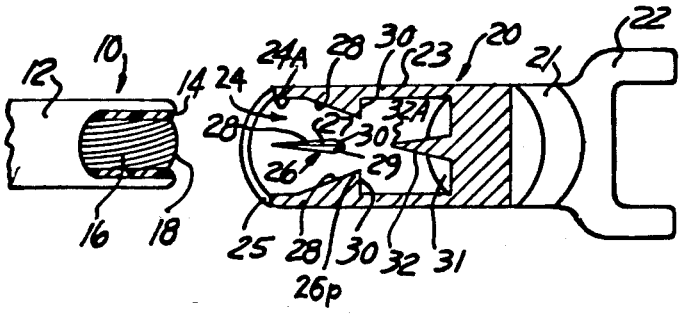
FIG. 2
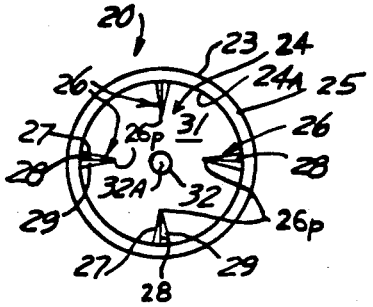
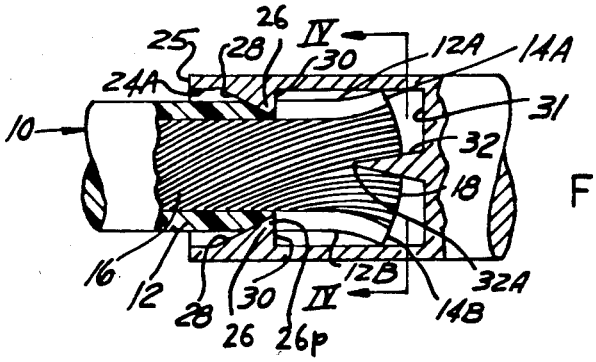
FIG. 3
FIG. 4
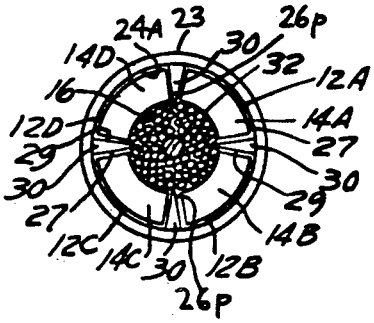

FIG. 5
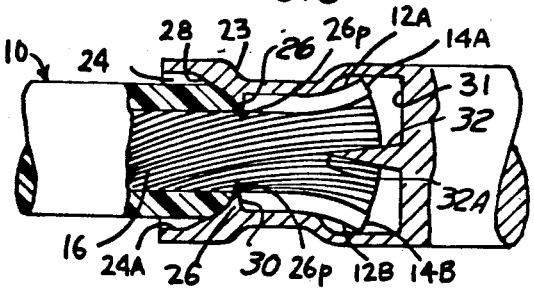
FIG. 6
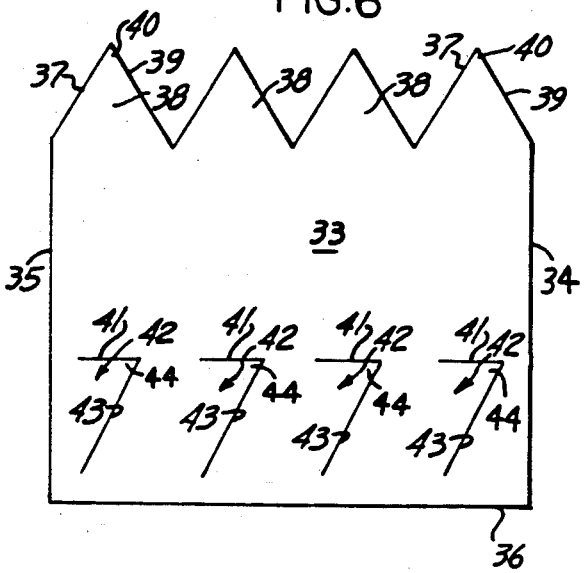
FIG. 9
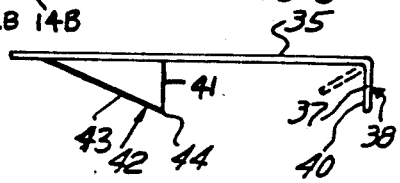
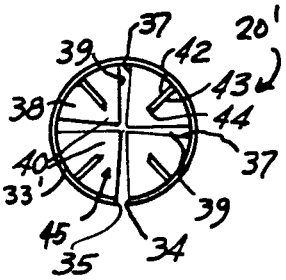
FIG. 10
FIG. 7
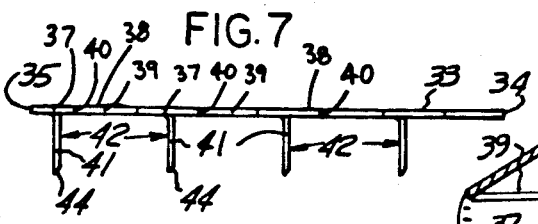
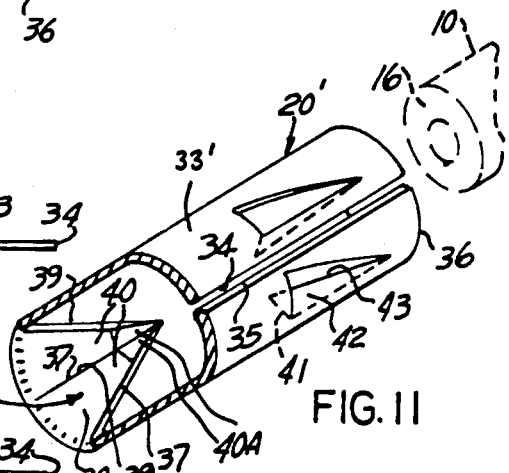
FIG. 11
FIG. 8
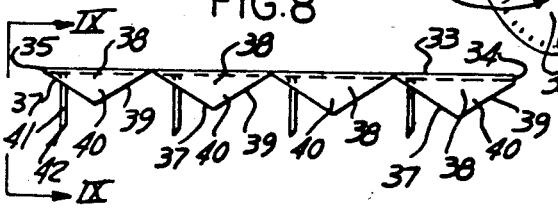

METHOD FOR ELECTRICAL CONNECTION TO THE CENTER CONDUCTOR OF AN INSULATED WIRE

This application is a division of application Ser. No. 505,651, filed June 20, 1983.

This invention relates to a terminal and method for electrical connection to the center conductor of an insulated wire.

Solderless electrical terminals characterized by a conductive ferrule including inwardly extending tines for piercing both outer insulation and center conductor of an insulated wire are known. However, insulated conductors used in electrical and electronic technologies of today utilize insulated jacketing of organic polymers such as polyvinyl chloride (PVC), polytetrafluoroethylene (TFE), extruded TFE, extruded fluorinated ethylene propolene (FEP) and flurocarbon/polyimide. The above noted organic polymer insulations have been recently developed for state-of-the-art electrical and electronic usage and are quite rugged. In some terminations complete penetration of the piercing tines through the insulation to make contact with the center conductor is doubtful. Further, some elastomeric insulations are quite resistant to inward compression and could force the ferrule including the piercing tine radially outward and from contact with the conductor after having been driven therewithin. Low voltage/current applications cannot function acceptably with a loose fit or with some outward release of the piercing tine. Further, to resist axial pull-out of the wire from the ferrule, some tines cut transversely of the wire axis. Unfortunately such a termination reduces tensile capability of the conductor within the insulation. Finally, electrical redundancy of an interconnection would be desirable.

Accordingly, a more desirable solderless electrical terminal would reliably penetrate the insulation of a conductor wire without compromising tensile capability of the conductor, resist axial pullout of the wire from the terminal and provide electrical redundancy.

A solderless terminal in accord with the present invention comprises a tubular sleeve of conductive material having an inner diameter slightly greater than the external diameter of an insulated wire having a stranded center conductor, the sleeve including a plurality of longitudinally extending fins for slicing the insulation into segments and penetrating the conductor, each fin extending radially inward from the interior wall of the sleeve and terminating in a sharp penetrating point adapted to slice through the insulation of the wire inserted within the sleeve so as to expose the conductor to the fin and to facilitate good penetration of the penetrating point upon radial inward collapse of the sleeve due to an external force thereon when the sleeve is crimped radially inward about the wire. The terminal further includes a conical spike disposed coaxially with the primary axis of the sleeve and terminating in an impaling tip, the impaling tip being adapted to penetrate into the center conductor to expand both the center conductor and the insulated wire segments radially outward, the radial inward crimp of the sleeve compressing the expanded insulation segments radially between the interior wall of the sleeve and the spike.

One advantage of a terminal according to this invention is provision of fins which longitudinally slice the insulation of a wire to be electrically and mechanically connected whereby inward radial penetration of the fin into the conductor is assured. Another advantage is provision of fins which terminate in a sharp penetrating point to expose the center conductor of the wire when the wire is inserted into the terminal. Yet another advantage is provision of a conical spike for impaling into the conductor to expand the wire radially outward whereby to wedge the insulation against the interior wall of the terminal to assist in mechanically holding and resisting axial pull-out forces placed on the wire. A further advantage is provision of a redundant electrical interconnection with the center conductor of a insulated wire as a result of the slicing fins and the conical spike penetrating the conductor. A terminating sleeve in accord with this invention could be manufactured as a separate part or stamped and rolled as an insert into a standard conductive sleeve having a spade or connective termination portion.

One way of carrying out the invention is described in detail below with reference to the drawings which illustrate specific embodiments of this invention, in which:

FIG. 1 is a terminal having an end portion, shown partially in section, positioned for application to an insulated wire having a center conductor, shown partially in section.

FIG. 2 is an end view of the terminal of FIG. 1.

FIG. 3 is a side view, partially in section, of the terminal receiving the end portion on the insulated wire.

FIG. 4 is an end view, taken along lines IV—IV of FIG. 3.

FIG. 5 is a side view, partially in section, of the terminal crimped to the insulated wire.

FIG. 6 shows a flat sheet stamped from metal to form a terminal.

FIG. 7 is an end view of the metal sheet with slicing fins extending perpendicularly therefrom.

FIG. 8 is an end view of the metal sheet with spike forming portions extending therefrom.

FIG. 9 is a side view of the metal sheet of FIG. 8.

FIG. 10 shows the metal sheet of FIG. 9 rolled into a tubular sleeve to form the terminal.

FIG. 11 is a perspective view of the terminal of FIG. 10 and shown partially in section.

Referring now to the drawings, FIG. 1 shows a terminal 20 for electrical and mechanical connection to a wire 10 of the type having a center conductor 16 surrounded by a sheath of insulation 12. The terminal 20 is comprised of an electrically conductive material and comprises a solid medial portion 21, a U-shaped portion 22 at one end for interconnecting the wire to a terminal lug (not shown) and a cylindrical portion forming a sleeve 23 at the other end, the sleeve 23 having a cylindrical interior wall **24*a* defining an axial passage 24 sized to receive the wire 10. The U-shaped portion 22** may be formed as a ring or any other desired configuration.

Preferably, center conductor 16 would be comprised of a plurality of conductive strands helically disposed, the separate strands being capable of untwisting (i.e., unwinding) so as to expand radially outward more easily so than would a solid conductor. One end of wire 10 is preferably cut so that both the center conductor 16 and insulation 12 have, respectively, flat end faces 18, 14.

The terminal 20 is fabricated such that the axial passage 24 is closed at one end by an end wall 31 formed by medial portion 21 and open at the other end as defined by end face 25. Axial passage 24 has an interior diameter approximating and being somewhat greater than the external diameter of conductor wire 10 so as to slidably receive the one end portion of wire 10 when the wire is inserted therewithin. A plurality of longitudinally extending fins 26 are disposed generally equiangularly around interior wall 24*a* for slicing the sheath of insulation 12 longitudinally from end face 14 thereof rearwardly to expose the conductor therein and a conical spike 32 is disposed on end wall 31 for penetrating the center conductor 16. Each of the slicing fins 26 extend radially inward from interior wall 24*a* and terminate in a sharp pentrating point 26*p* for penetrating the center conductor 16 upon radial inward collapse of the sleeve 23 due to an external force placed thereupon. Conical spike 32 has its axis coaxially aligned with the principal axis of sleeve 23 and terminates in a tip 32A longitudinally forward from end wall 31 for centrally impaling conductor 16. The slicing fins 26 sidewise define an acute right-angled triangle relative to interior wall 24*a* and each fin includes a transverse rear face 30 and an acutely-angled slicing edge 28 which intersect to form the penetrating point 26*p*. The fins are axially spaced from impaling tip 32A of conical spike 32 and each fin has its rear face 30 facing end wall 31. To provide support and strain relief for wire 10, the fins 26 are disposed longitudinally inward from end face 25.

FIG. 2 is an end view of terminal 20 looking into passage 24. Preferably, four like-shaped slicing fins 26 are disposed substantially at 90° to one another around interior wall 24*a*, each fin further being generally V-shaped in transverse cross-section and including flank surfaces 27, 29 which extend radially inward from interior wall 24 and intersect to define the slicing edge 28. Conical spike 32 extends from end wall 31 and has its tip 32A coaxially aligned with the principal axis of sleeve 23.

FIG. 3 shows the one axial end portion of wire 10 inserted into sleeve 23. Although shown best in FIG. 4 the slicing fins 26 completely slice the sheath of insulation 12 and form four arcuate insulation segments 12A, 12B, 12C, 12D having, respectively, transverse end faces 14A, 14B, 14C, 14C, each insulation segment extending longitudinally rearward from its respective segment end face. The sharp penetrating point 26*p* of each slicing fin 26 slightly scores the conductor 16 longitudinally as result of the longitudinal insertion of wire 10 within terminating sleeve 23 to seat the slicing fin for termination therewith. Conical spike 32 is driven into end face 14 and its tip 32A is axially impaled within the conductor 16, the sliced insulation segments thereby allowing the stranded conductor and insulation segments to expand radially outward and the insulation segments to be slightly wedged against interior wall 24*a*.

FIG. 4 is an end view of terminal 20 showing wire 10 inserted within sleeve 23, the four arcuate insulation segments 12A, 12B, 12C and 12D formed by fins 26 slicing the insulation end faces 14A, 14B, 14C and 14D and conical spike 32 with its tip 32A impaled into conductor 16. Center conductor 16 is helically stranded.

FIG. 5 shows inward radial collapse of sleeve 23 after having been crimped radially inward around the end portion of wire 10, the external force driving the sharp penetrating points 26*p* of each slicing fin 26 radially inward and into stranded conductor 16 therewithin and the insulation segments 12A, 12B, 12C, 12D to radially expand and fill an annular recess formed around conical spike 32 and interior wall 24*a* adjacent end wall 31 to form a compressed force fit therebetween which resists axial pull-out forces on the wire.

Preferably, a radially inward indent circle would be formed around terminating sleeve 23 at an axial position slightly rearward of abutment faces 30 on slicing fins 26 and forwardly of tip 32A of conical spike 32. Many suitable forms of crimping are known. It is contemplated that the crimping would be much as described in U.S. Pat. Nos. 4,272,150 issuing June 9, 1981 to Fairbairn, "Electrical Contact for an Electrical Connector" or 4,278,317 issuing July 14, 1981 to Gallusser et al, "Formed Socket Contact with Reenforcing Ridge," the specification of each being incorporated herein by reference. In particular, four symetrically arranged arcuate dies would be positioned about the terminal sleeve and aligned with each of the slicing fins and the dies moved simultaneously radially inward to provide four indents about the sleeve 23.

As a result of the inward crimping by the dies, the sharp penetrating point 26*p* of each slicing fin 26 is driven into conductor 16 and insulated segments 12A, 12B, 12C and 12D radially expanded by spike 32 into the sleeve recess.

FIGS. 6–10 relate to a method of forming a terminal 20' by stamping and forming a terminating sleeve 33' from a substantially flat sheet 33 of metal stock.

FIG. 6 shows a generally flat, rectangular, metal sheet 33 comprising a pair of substantially parallel longitudinal edges 34, 35, a forward lateral edge 36 and a toothed rearward lateral edge defined by four V-shaped sheet portions 38, each V-shaped sheet portion 38 being defined by respective lateral edge portions 37, 39 which intersect to form an included acutely angled tip portion 40. The V-shaped sheet portions 38 are symmetrically disposed and form a continguous succession of teeth between longitudinal edges 35, 34 with one of the lateral edge portions 37 extending from longitudinal edge 35 to initiate the first V-shaped sheet portion 38 and one of the other lateral edge portions 39 extending from longitudinal edge 34 to terminate the last V-shaped sheet portion 38. Alternatively, lateral edge portions 39, 37 could extend from longitudinal edges 35, 34, respectively whereupon three complete and two half complete V-shaped sheet portions 38 would be described between the longitudinal edges.

Four generally acute, right-angled, triangular shaped fins 42 are stamped from an intermediate portion of sheet 33 with each fin 42 being substantially alike in shape and comprising first and second edges 41, 43 sheared from the sheet, each of the first edges 41 extending along a line parallel to forward lateral edge 36 and perpendicular to longitudinal edges 35, 34 and the second edges 43 being disposed at an acute angle to longitudinal edges 35, 34. The fins 42 terminate in a sharp penetrating point 44 as defined by the intersection of the first and second edges 41, 43 with each of the second edges 43 defining an insulation slicing edge.

FIG. 7 is an end view of sheet 33 showing lateral edge portions 37, 39 forming the tip portions 40 and the succession of V-shaped sheet portions 38 thereacross. The four fins 42 have been struck downwardly from and are substantially perpendicular to the plane of sheet 33. Each of the second edges 43 would be coined so that their edge faces are acutely-angled with respect to a plane forming each respective fin 42 to form an insulation slicing edge.

FIG. 8 shows the four V-shaped sheet portions 38 struck downwardly from and substantially perpendicular to the plane of sheet 33.

FIG. 9 shows each V-shaped sheet portion 38 being folded downwardly towards the plane of sheet 33 and each respective tip portion 40 pointing towards the first edges 41 of fins 42 such that a plane including the V-shaped sheet portions 38 will be at an acute-angle relative to the plane of sheet 33. The dotted lines show the final position of the sheet portions 38.

FIG. 10 shows sheet 33 rolled into a cylinder to form a sleeve 33' and define a terminal 20'. When rolled, opposite longitudinal edges 35, 34 adjoin one another to form a longitudinal seam. The fins 42 are disposed substantially at 90° to one another and have their sharp penetrating points 44 converging radially inward toward the axis of the cylinder. The V-shaped sheet portions 38 extend radially inward to the axis of the sleeve 33' with the V-shaped tip portions 40 converging together so that edge portions 37, 39 of one tip portion 40 are adjoining with like edge portions 39, 37 of each adjacent tip portion to form in combination, a substantially continuous conical spike 45.

FIG. 11 shows a perspective view of the stamped and formed terminal 20' comprising the cylindrical sleeve 33' with a portion of the sleeve being cut away to show a portion of the conical spike 45 formed by sheet portions 38 converging. The dotted lines on sleeve 33' show inward radial extensions of fins 42 and the insulated conductor wire 10 positioned for axial insertion therein. Each of the V-shaped tip portions 40 have their ends 40A slightly coined to form, in combination, a sharp impaling point.

Although not shown by FIG. 11, the rolled sleeve could be inserted into an axial passage formed by a ferrule of a spade or ring type terminal lug and the sleeve and terminal lug then crimped together about an insulated conductor wire. Although only one surface of each tip portion 40 is coined, both could be coined.

We claim:

1. A method of making an electrical terminal for electrical connection to the center conductor of an insulated wire, said method characterized by:

stamping a flat sheet of metal into an elongated generally rectangular shape, said sheet being defined by a pair of longitudinal edges and by a pair of lateral edges, cutting into the sheet to form a plurality of V-shaped fins, forming a plurality of V-shaped sheet portions along one lateral edge, each V-shaped sheet portion including lateral edge portions which terminate in a tip portion, bending each of said V-shaped fins upwardly from the plane of the sheet so as to be longitudinally extending and substantially perpendicular thereto, folding each of said V-shaped tip portions upwardly from the plane of the sheet and then downwardly towards the plane of the sheet so that the tip portions are pointing towards the fins, and rolling said sheet into a tubular sleeve by progressively bending the longitudinal edges around to a position where said longitudinal edges adjoin at a seam, said rolling disposing said fins and said V-shaped tip portions internally of said sleeve, said fins being disposed in a longitudinal plane passing through the primary axis of the sleeve, and said V-shaped tip portions converging together to form a conical spike the axis of which is generally coaxial to the sleeve.

2. A method of making an electrical connection between a terminal and the stranded conductors of an insulated wire, said terminal comprising a sleeve including an interior cylindrical passage the diameter of which being slightly greater than the diameter of said insulated wire and having an interior end wall, said method characterized by:

providing the interior cylindrical wall of the passage with a plurality of longitudinally extending fins for slicing the insulator and the end wall with a longitudinally extending conical spike for penetrating the conductors, the fins having a slicing edge each which are disposed in a plane passing generally through the axis of the passage and the spike having its tip coaxially aligned with the axis of the passage, longitudinally inserting the end portion of said wire into said passage whereby said fins slice through the insulation of said wire, forcing the end portion of said wire axially inward into said passage and against said conical spike whereby the tip of said spike penetrates into said stranded conductors, and applying an external force radially inward to said sleeve to drive said fins inwardly and drive there penetrating points into contact with the stranded conductors whereby the penetration by said pentrating points and said tip with the stranded conductors forms a mechanical and electrical connection between the wire and the terminal.

* * * * *